US006648265B2

(12) United States Patent
Goldberg

(10) Patent No.: US 6,648,265 B2
(45) Date of Patent: Nov. 18, 2003

(54) APPARATUS FOR REGULATING THE DISPENSING OF SHEETS FROM A ROLL OF SHEETS

(76) Inventor: David Goldberg, 447 Avery Road, Kelowna, British Columbia (CA), V1Y 4H8

( * ) Notice: Subject to any disclaimer, the term of this patent is extended or adjusted under 35 U.S.C. 154(b) by 0 days.

(21) Appl. No.: 10/199,083

(22) Filed: Jul. 22, 2002

(65) Prior Publication Data

US 2003/0019972 A1 Jan. 30, 2003

Related U.S. Application Data

(60) Provisional application No. 60/307,328, filed on Jul. 24, 2001, provisional application No. 60/350,693, filed on Jan. 24, 2002, and provisional application No. 60/359,105, filed on Feb. 25, 2002.

(51) Int. Cl.[7] ..... B65H 23/06
(52) U.S. Cl. ..... 242/422.5; 242/580
(58) Field of Search ..... 242/422.5, 580; D6/512

(56) References Cited

U.S. PATENT DOCUMENTS

| | | | | | |
|---|---|---|---|---|---|
| 1,091,450 | A | | 3/1914 | Anable | |
| 1,243,569 | A | | 10/1917 | Taylor | |
| 1,330,005 | A | | 2/1920 | Ranney | |
| 1,800,030 | A | * | 4/1931 | Reynolds | 211/123 |
| 1,947,340 | A | | 2/1934 | Hallwood | |
| 2,749,056 | A | | 6/1956 | Jenkins | |
| 3,170,652 | A | | 2/1965 | Kennedy | |
| 3,850,379 | A | | 11/1974 | Stern | |
| 4,093,138 | A | | 6/1978 | Shafer | |
| 4,285,474 | A | | 8/1981 | Perez | |
| 4,466,563 | A | | 8/1984 | Zuss | |
| 4,606,485 | A | | 8/1986 | Rankin | |
| 4,610,407 | A | | 9/1986 | Stubbmann | |
| D311,835 | S | | 11/1990 | Bamman | |
| 5,054,675 | A | | 10/1991 | Taves | |
| 5,623,880 | A | * | 4/1997 | Kuntz | 108/42 |
| 5,762,285 | A | * | 6/1998 | Lin | 242/565 |
| 2002/0130211 | A1 | * | 9/2002 | Kerr | 242/422.5 |

FOREIGN PATENT DOCUMENTS

| | | | |
|---|---|---|---|
| EP | 0509902 A1 | * | 4/1992 |
| WO | WO8900968 | * | 2/1989 |

* cited by examiner

*Primary Examiner*—Kathy Matecki
*Assistant Examiner*—Evan Langdon
(74) *Attorney, Agent, or Firm*—Antony C. Edwards

(57) ABSTRACT

An apparatus or device for controlling dispensing of flexible sheets from a continuous roll of sheets releasably mounted on a spindle includes a generally U-shaped member having a spaced apart parallel pair of legs, a cross member interconnecting the pair of legs, and a brake arm cantilevered from the cross member so as to extend between the legs. The U-shaped member is sized to fit over and bracket the ends of the roll of sheets so as to nest the roll boxed-in between the pair of legs and the cross member.

18 Claims, 4 Drawing Sheets

Fig 1
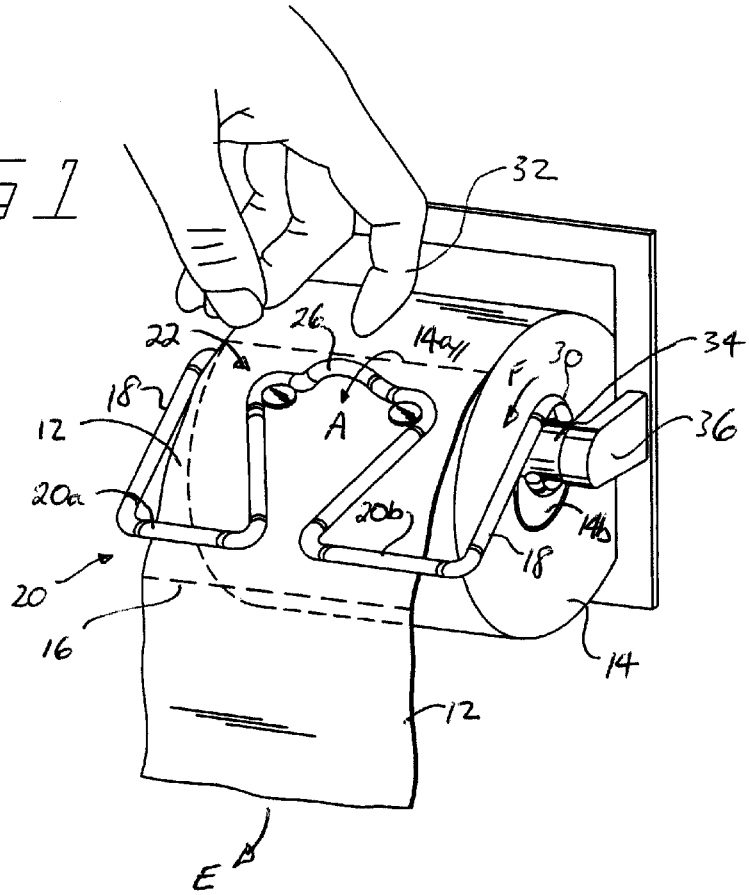
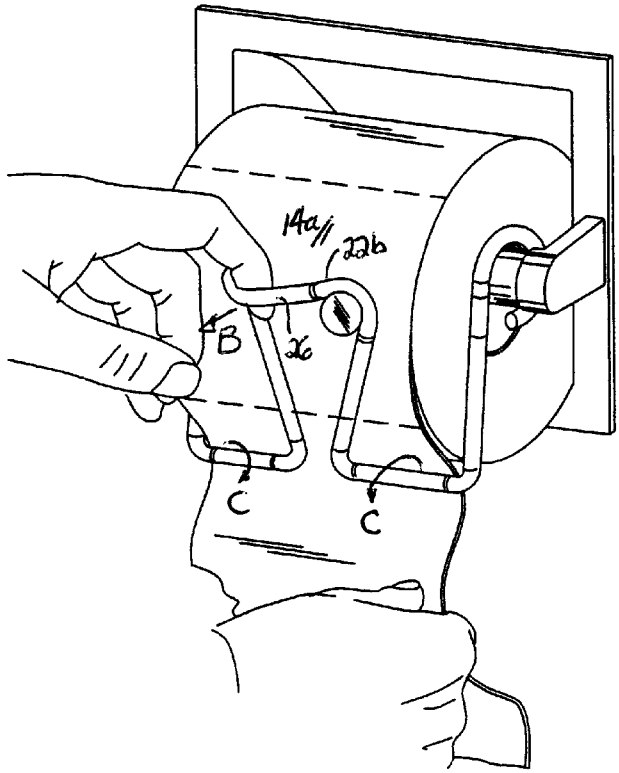
Fig 2

Fig 6
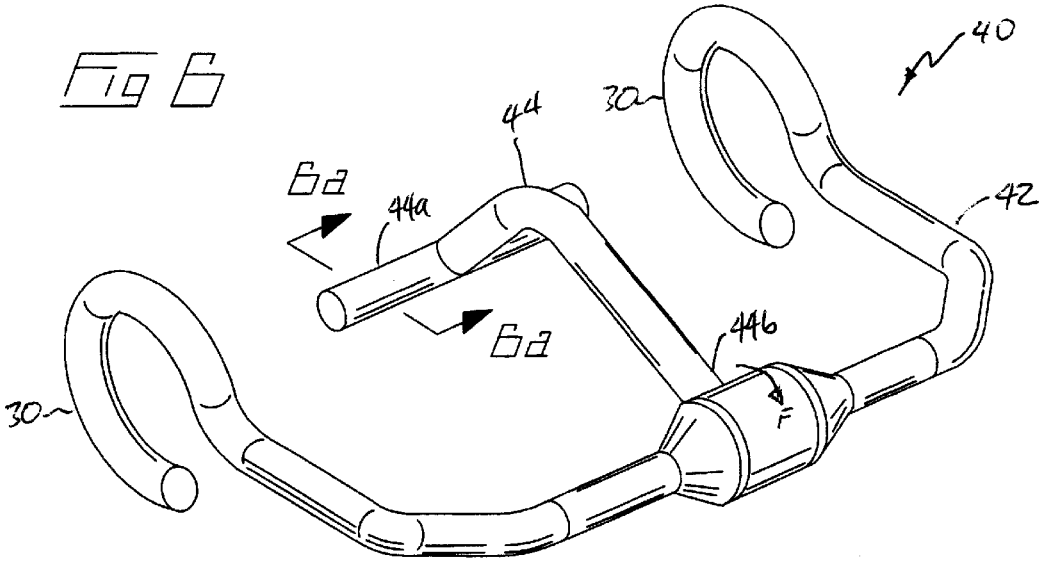
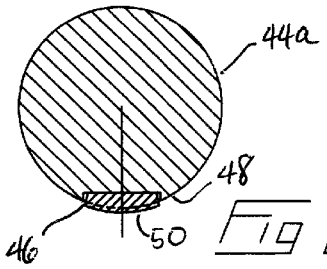
Fig 6a
Fig 7
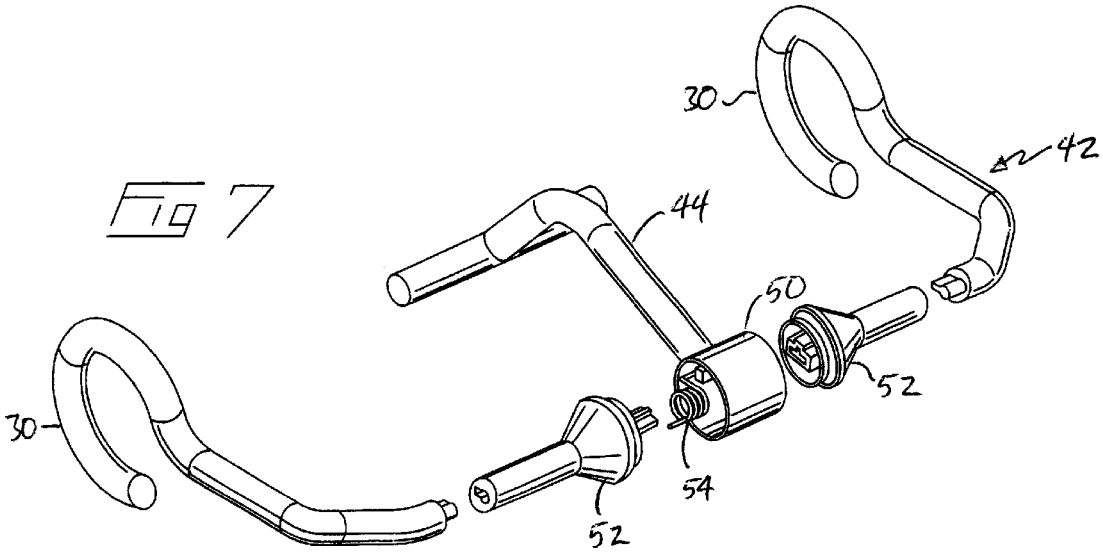

APPARATUS FOR REGULATING THE DISPENSING OF SHEETS FROM A ROLL OF SHEETS

CROSS REFERENCE TO RELATED APPLICATION

This application claims priority from U.S. Provisional Patent Application No. 60/307,328 filed Jul. 24, 2001 entitled Toilet Paper Locking Device, U.S. Provisional Patent Application No. 60/350,693 filed Jan. 24, 2002 entitled Toilet Paper Saver and U.S. Provisional Patent Application No. 60/359,105 filed Feb. 25, 2002 entitled Toilet Paper Saver.

FIELD OF THE INVENTION

This invention relates to the field of devices for dispensing sheets from sheet rolls for example toilet paper or paper towel rolls and in particular to a manually operable roll brake for retro-fit onto existing spindle-mounted continuous roll of sheets.

BACKGROUND OF THE INVENTION

It is a recognized problem that, if unregulated, the dispensing of sheets from a roll of sheets such as those typically found in a roll of toilet paper where individual sheets are separated along perforated joints, may dispense far too many sheets than are necessary for the intended use. For example this may occur where a child or domestic pet is playing with an unregulated roll of toilet paper or paper towel, or may occur in a public washroom where a malcontent merely wishes to make a mess by pulling long handfuls of toilet paper from an unregulated dispenser.

Quite apart from solving the above problem, it is self evident that reducing the volume of toilet paper used is beneficial from at least a cost savings point of view and from the point of view of reducing the mass of paper entering our waste disposal systems.

Where unregulated, a single pull on one end of for example a roll of toilet paper may result in the dispensing of many feet of paper from the roll before the friction of the central tube of the roll rubbing against the spindle or roller (hereinafter collectively referred to as a spindle) of the dispenser slows the rotation of the roll to a stop. Such an excess unrolling may also inadvertently occur in an unregulated dispenser where a user merely tries to separate a handful of perforated sheets from the sheets remaining on the roll by tugging on the freely hanging sheets without controlling the rotation of the roll for example with the other hand.

One solution has been proposed in the prior art by Jenkins in his U.S. Pat. No. 2,749,056 which issued Jun. 5, 1956 for his Toilet Paper Dispenser. What Jenkins discloses is a toilet paper dispenser which includes a pressure pad to brake the paper roll against inadvertent or unwanted unwinding of an excess quantity of paper and to hold the roll while a portion is being torn therefrom. This is accomplished in the teaching of Jenkins by mounting the dispenser to a wall and providing both a brake or pressure pad on a pivotally mounted arm which is resiliently urged against the paper roll, and a separate cantilevered finger support bracket mounted to the back plate of the dispenser. In operation, Jenkins teaches that the brake arm is scissored towards the finger support bracket by pinching the two together thereby pivoting the arm and releasing the friction of the pressure pad resting on the paper roll. Jenkins states that the finger support bracket is used to steady the hand and to act as a fixed element which can be contacted simultaneously with the brake by the thumb and a finger of one hand of the operator to improve the purchase of the hand, further noting that this enables children to operate the device while still providing sufficiently strong braking action.

Thus as may be seen, the Jenkins device is neither well suited to prevent children unwinding the paper roll nor for retro-fit to existing spindle mounted rolled sheet dispensers because of the requirement that the brake pad arm be pivotally mounted to the back plate of the dispenser and that the cantilevered Finger support also be mounted to the back plate of the dispenser. In the present invention, these limitations are overcome by the providing of a brake arm which is mounted within the confines of a generally U-shaped member which may be clipped or otherwise releasably mounted onto the opposite ends of the spindle astride a roll of rolled sheets mounted onto the spindle. Thus in the present invention the retro-fit is a simple matter of affixing the distal ends of the U-shaped support member to the ends of the spindle so as to urge the brake arm mounted to the cross member of the U-shaped member against the exterior surface of the roll.

SUMMARY OF THE INVENTION

The apparatus or device according to the present invention for controlling dispensing of flexible sheets from a continuous roll of sheets releasably mounted on a spindle includes a generally U-shaped member having a spaced apart parallel pair of legs, a cross member interconnecting the pair of legs, and a brake arm cantilevered from the cross member so as to extend between the legs. The U-shaped member is sized to fit over and bracket the ends of the roll of sheets so as to nest the roll boxed-in between the pair of legs and the cross member. A pair of releasable mounting means are mounted on the distal ends of the pair of legs, distal from the cross member, for releasably mounting the pair of legs onto opposite ends of the spindle so as to bracket the roll of sheets mounted on the spindle. The mounting means are adapted to suspend the U-shaped member from the spindle as the sole support for the U-shaped member. The U-shaped member is not adapted to be wall-mounted, but rather is adapted for retro-fit onto existing spindle mounted roll dispensers.

The brake arm is mounted cantilevered at a first end thereof from the cross member so as to extend cantilevered between the pair of legs, and so as to be rotatable relative to the cross member. The brake arm is rotatable between an equilibrium position and a roll engaging position and between the roll engaging position and a roll releasing position. In the roll engaging position the brake arm is resiliently biased by biasing means towards a plane containing the pair of legs and against the roll of sheets when mounted on the spindle. In the roll releasing position the brake arm has been rotated about an axis of rotation substantially perpendicular to the pair of legs so as to rotate a distal end of the brake away from contact with the roll of sheets against a return biasing force of the biasing means, whereby the distal end of the brake arm is released from frictional engagement with a cylindrical, outermost surface of the roll of sheets.

In a preferred embodiment the brake arm is mounted substantially medially along the cross member and the mounting means may be a pair of clips adapted to clip over the spindle on either side of the roll of sheets on the spindle. For example, the pair of clips may be a substantially parallel pair of toroidal collars. Each collar of the pair of collars may be resilient, each collar having a central aperture therethrough for retaining an end of the spindle journalled therein, and a gap providing for clipping of the each collar over an end of the spindle without having to remove the spindle from a corresponding wall mounting bracket.

In one embodiment the brake arm and at least the cross member of the U-shaped member are resilient, and may be formed from one continuous integral piece. Although not intending to be limiting, the brake arm may be generally ▽-shaped and the ▽ shape may be contained generally within the U-shaped member when the brake arm is in the equilibrium position lying substantially in the plane of the U-shaped member and the U-shaped member is removed from the spindle. The narrow end of the ▽-shaped brake arm may be mounted to the cross member, in which case the wider end engages the roll of sheets. The "▽" shape may remain substantially planar as the brake arm is rotated from the equilibrium position into the roll engaging position and from the roll engaging position into the roll releasing position. The wider end of the brake arm, at the distal end of the brake arm, may have a finger receiving curvature or other pull means formed therein or mounted thereon for hooking or pulling of the brake arm by a user.

The cross member may have two sections, each section extending oppositely disposed to the other between the narrower end of the brake arm and the pair of legs, each section resiliently twisting along its length during the rotation of the brake arm between the equilibrium position and the roll releasing position so as to provide the biasing means.

Friction enhancing means may be provided, for example mounted at the distal end of the brake arm for increasing friction between the brake arm and the surface of the roll of sheets when the brake arm is in the roll engaging position. The friction enhancing means may, without intending to be limiting, be tacky or otherwise slip-inhibiting pads or inserts or may be serrated teeth or raised flanges or other gripping means.

In a further embodiment, again without intending to be limiting, the brake arm may be rotatably mounted by a swivel mounted on the cross member, in which case the biasing means may be a spring mounted in the swivel so as to be rigidly mounted at one end of the spring to the brake arm and at an opposite end of the spring to the cross member. The brake arm may be T-shaped and a cross piece of the T-shape may, at the distal end of the brake arm, engage the roll of sheets. The pads may be mounted on lands on the distal end of the brake arm.

BRIEF DESCRIPTION OF THE DRAWINGS

FIG. 1 is, in perspective view, the apparatus according to one embodiment of the present invention mounted onto a spindle so as to bracket a roll of sheets mounted onto the spindle, the brake arm of the apparatus in its roll engaging position.

FIG. 2 is, in perspective view, the view of FIG. 1 wherein the brake arm has been rotated to its roll releasing position.

FIG. 6 is, in perspective view, a further embodiment of the apparatus according to the present invention.

FIG. 6*a* is a sectional view along line 6*a*—6*a* in FIG. 6.

FIG. 7 is, in exploded perspective view, the apparatus of FIG. 6.

DETAILED DESCRIPTION OF EMBODIMENTS OF THE INVENTION

Figure 3:
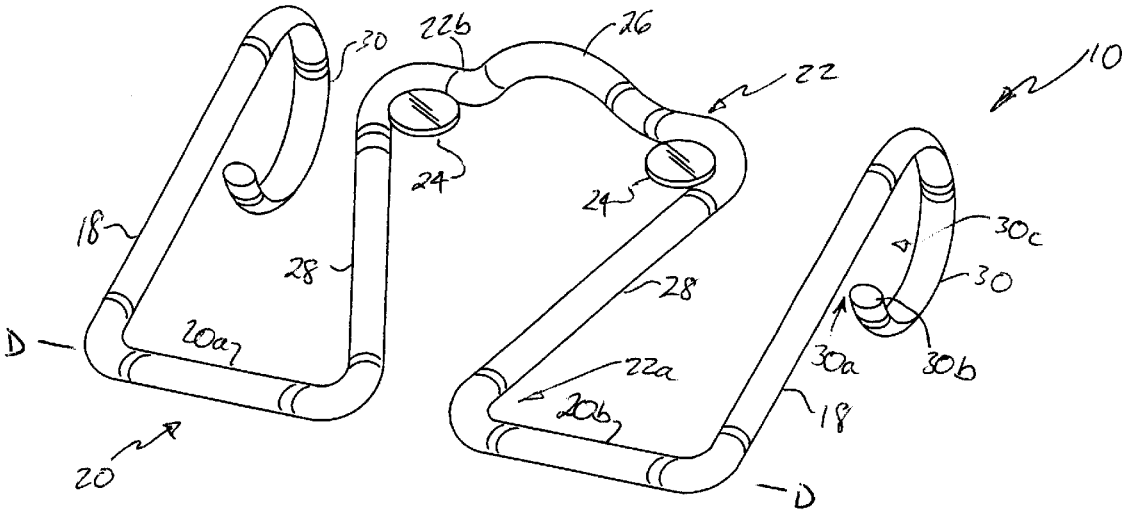
FIG. 3 is, in perspective view, the apparatus of the present invention according to the embodiment of FIG. 1 with the brake arm in its equilibrium position.

In FIGS. 1–9 wherein similar characters of reference denote corresponding items in each view, the operation of the invention according to one embodiment is best understood by a review of FIGS. 1 and 2, the invention seen best in FIG. 3. Thus, as seen in FIGS. 1–3, the apparatus 10 for regulating the dispensing of sheets 12 from a continuous roll of sheets 14, wherein typically each sheet is separated from an adjacent sheet in a roll by a line of perforations 16, includes a generally U-shaped member having a pair of legs 18 joined together so as to be supported in a parallel spaced apart array by a cross member 20. In this embodiment, cross member 20 has two generally coaxial elongate elements 20*a* and 20*b* which extend between so as to connect legs 18 with the narrow end 22*a* of a "▽"-shaped brake arm 22.

The distal end 22*b*, opposite to narrow end 22*a* on brake arm 22 supports a pair of friction pad holders 24 in the vertices of the ▽-shape at distal end 22*b*. The cross bar 26 of brake arm 22 is curved out of the plane containing the cantilevered arms 28 of the ▽-shape so as to provide a curvature or pull disposed in an opposite direction to the pair of annular clip rings 30 mounted on the distal ends of legs 18. When distal end 22*b* is lying against the outer surface 14*a* of the roll of sheets 14 a user may hook a digit such as index finger 32 under curvature 26 so that brake arm 22 may be pulled away from contact with the roll of sheets 14.

In particular, in this embodiment which is not intended to be limiting the entire U-shaped member including legs 18 and cross member 20, and brake arm 22, and clip rings 30 are formed of a single unitary elongate resilient member. Thus, with clip rings 30 clipped onto the ends of spindle 34 protruding from the tubular core 14*b* of the roll of sheets 14, it being understood that clip rings 30 may be snapped into place without the necessity of removing spindle 34 from its wall mounting brackets 36 by passing spindle 34 through the entryway gap 30*a* between legs 18 and the free ends 30*b* of clip rings 30, a digit such as index finger 32 may, once hooked under curvature 26. Finger 32 applies a bending moment in direction A to curvature 26. A resulting force in tension in direction B thereby twists sections 20*a* and 20*b* of cross member 20 in directions C as distal end 22*b* is pulled in the direction of force B away from contact with surface 14*a*.

Figure 4:
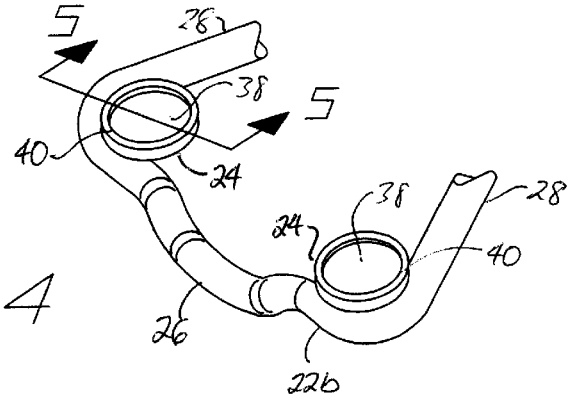
FIG. 4 is, in partially cut away bottom perspective view, the wider end of the brake arm of FIG. 3 showing the friction enhancing pad receiving lands.
Figure 5:
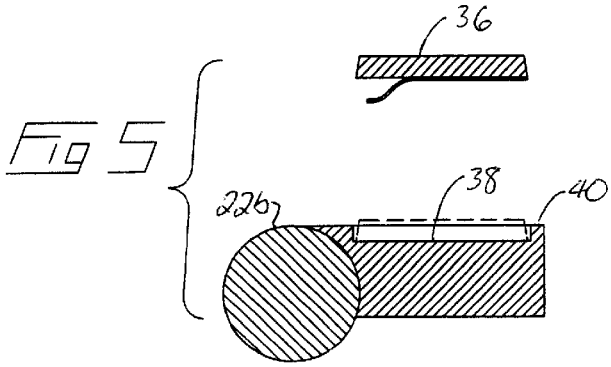
FIG. 5 is an exploded view along line 5—5 in FIG. 4 showing a friction enhancing pad with its backing partially removed to expose its adhesive underside prior to mounting of the pad onto the pad receiving land.

As better seen in FIGS. 4 and 5, in this embodiment again not intended to be limiting, the friction applied by brake arm 22 against surface 14*a* is enhanced by the use of friction pads 36 which may for example be soft adhesive-backed buttons of for example rubber-like material or other resilient materials having a slightly tacky surface or otherwise provide for enhanced frictional engagement between the bearing of distal end 22*b* against surface 14*a*. Pads 36 are mounted onto lands 38, for example so as to be peripherally supported by raised annular rims 40 on lands 38.

In FIG. 3 apparatus 10 is shown with brake 22 in its equilibrium position wherein the plane containing cantilevered arms 28 is generally parallel or coplanar with a plane containing legs 18. In this position, no force has been applied to brake arm 22 and consequently no torsional stress has been imparted to sections 20*a* and 20*b* of cross member 20. Once clip rings 30 have been installed onto spindle 34 by the passing of spindle 34 through the slightly narrower gap 30*a* so that spindles 34 are journalled in clip ring openings 30*c*, the presence of roll 14 bracketed at its ends by legs 18 forces brake arm 22 to rotate about its axis of rotation D so that the plane containing brake arm 22 is no longer parallel or coplanar with the plane containing legs 18. This imparts torsional stress to sections 20*a* and 20*b* of cross member 20. Because apparatus 10 and in particular cross member 20 is made of a resilient material such as ABS plastic or such as would be known to one skilled in the art. Such a material allows for repeated torsional twisting cycles to be applied without significant hysteresis reducing the resilient return biasing force of the cross member sections resiliently urging brake arm 22 to return to its equilibrium position. Thus the result of deflecting brake arm 22 when legs 18 are installed over the ends of roll 14 is to force at least distal end 22*b* against surface 14*a*. Whether or not friction enhancing means arc employed, the result is that there is frictional engagement between brake arm 22 and roll 14 so that, without relieving the frictional force, for example by further deflecting brake arm 22 along the direction of force B, a person trying to pull the free end of sheets 12 or example in direction E will result in zero or minimal rotation of roll 14 in direction F about spindle 34 before one or more of any exposed lines of perforations 16 give way thereby dispensing only a single or a minimal number of sheets 12 for each pull in direction E on the free end of the roll of sheets.

Thus as may now be better understood by review of FIG. 2, in order to dispense a significant or otherwise useful number of sheets 12 from roll 14, a user first must detach brake arm 22 from its frictional engagement against roll 14 with one hand and with the other hand then tug on the free end of the roll sheets. Once the required number of sheets have been dispensed force B is released so as to allow brake arm 22 to re-engage against surface 14*a*. Whether this be employed for a roll of paper such as toilet paper or for other flexible sheet materials, it is likely that the requirement of two handed use where a first hand unlocks the braking mechanism and a second had dispenses the sheets will defeat the effort of a child to unravel the roll or may frustrate the non-persistent attempt by a malcontent to unravel the roll.

As noted above, it is not intended that the detailed description of this first embodiment be limiting. For example, curvature 16 may be replaced with another form of pull which may be grasped or otherwise hooked manually by a user. Further, it may not be required that the entire apparatus 10 be formed of resilient material and in fact as seen in the embodiment of FIGS. 6–9, the resilient material of apparatus 10 may be replaced with the rigid components of apparatus 40. Again, apparatus 40 has a generally U-shaped member 42 which supports medially along its cross member a pivotable brake arm 44, in this case generally T-shaped although this in not intended to be limiting. As seen in FIG. 6*a*, the cross bar 44*a* of brake arm 44 may have a groove or other recess 46 formed in its bearing surface 48 which bears against surface 14*a* of roll 14 into which may be mounted friction enhancing material 50 such as described above in relation to pads 36.

Figure 8:
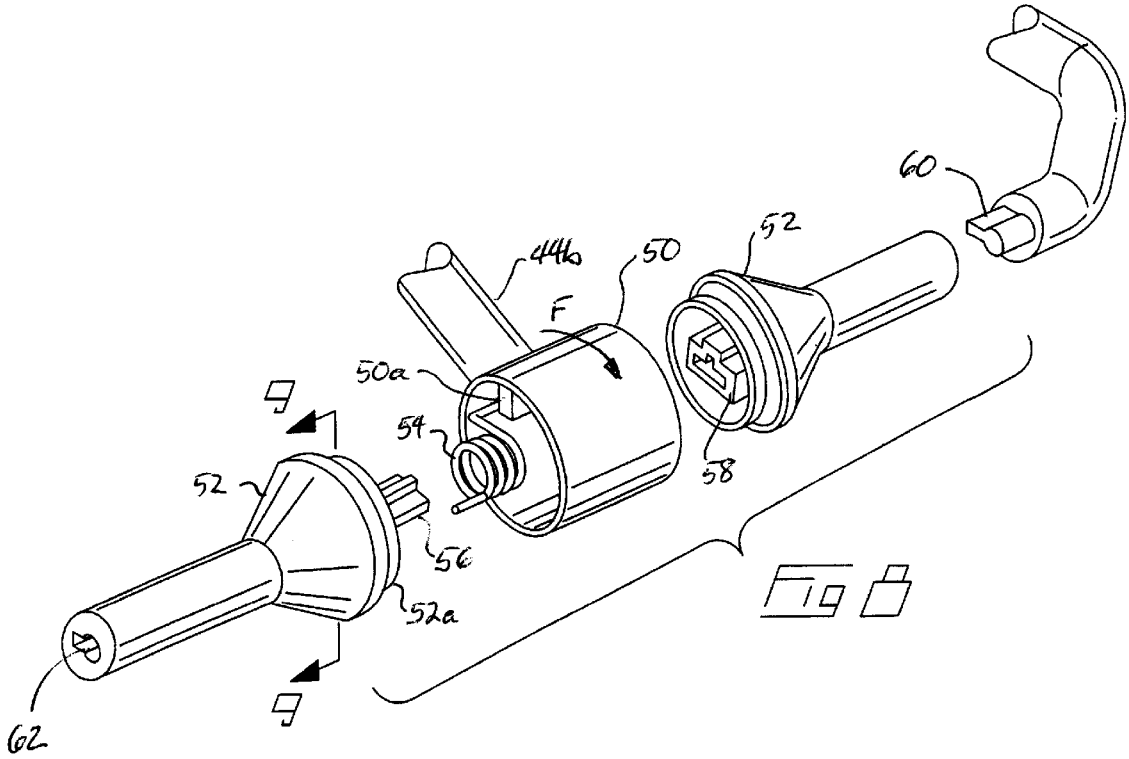
FIG. 8 is an enlarged partially cut away view of the exploded view of FIG. 7.
Figure 9:
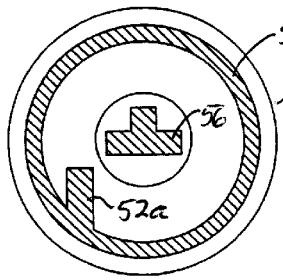
FIG. 9 is a sectional view along line 9—9 in FIG. 8.

As better seen in FIGS. 7–9, the base end 44*b* of brake arm 44 is mounted to a collar or swivel 50 rotatably mounted between opposed facing frusto-conical caps 52. A helical spring 54 has one end locked behind a rigid bearing flange 50*a* protruding into a hollow cavity within swivel 50, the opposite end of helical spring 54 bearing against a rigid flange 52*a*. Flanges 50*a* and 52*a* arrest motion of the ends of helical spring 54. Thus, pivoting of brake arm 44 in direction F, as would happen if brake arm 44 was rotated from its equilibrium position in FIG. 6 into a roll engaging position corresponding to FIG. 1 or a roll releasing position corresponding to FIG. 2, results in the resilient biasing of brake arm 44 against roll 14 until the roll is either removed or depleted to the extent that the brake arm returns to its equilibrium position. Although again not intended to be limiting, helical spring 54 may be journalled onto axle member 56, the end of which mates into a female mating receptacle 58 thereby providing for stably rotatably mounting swivel 50 between caps 52. In this embodiment, the arms and cross members of U-shaped member 42 may be modular and interlocking for example by inserting non-cylindrical male members 60 into snug mating engagement in corresponding keyways 62. This modularity allows for the use of rigid components supporting swivel 50 and may allow for the use of resilient or slightly less rigid components forming clip rings 30 and the corresponding legs of U-shaped member 42.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance declined by the following claims.

What is claimed is:

1. A device for controlling dispensing of flexible sheets from a continuous roll of sheets releasably mounted on a spindle, the device comprising:

a generally U-shaped member having a spaced apart parallel pair of legs and a cross member interconnecting said pair of legs, said U-shaped member sized to fit over the roll of sheets so as to nest the roll boxed-in between said pair of legs and said cross member, a pair of releasable mounting means mounted on the distal ends of said pair of legs, distal from said cross member, for releasably mounting said pair of legs onto opposite ends of the spindle so as to bracket the roll of sheets mounted on the spindle, and wherein said mounting means are adapted to suspend said U-shaped member from said spindle as the sole support for said U-shaped member, and wherein said U-shaped member is not adapted to be wall-mounted, a brake arm mounted cantilevered at a first end thereof from said cross member so as to extend cantilevered between said pair of legs, said brake arm rotatable relative to said cross member between a roll engaging position wherein said brake arm is resiliently biased by biasing means towards a plane containing said pair of legs and against the roll of sheets when mounted on the spindle, and a roll releasing position wherein said brake arm has been rotated about an axis of rotation substantially perpendicular to said pair of legs so as to rotate a distal end of said brake away from contact with the roll of sheets against a return biasing force of said biasing means, whereby said distal end of said brake arm is released from frictional engagement with a cylindrical, outermost surface of the roll of sheets.

2. The device of claim 1 wherein said brake arm is mounted substantially medially along said cross member.

3. The device of claim 2 wherein said mounting means are a pair of clips adapted to clip over the spindle on either side of the roll of sheets on the spindle.

4. The device of claim 3 wherein said pair of clips are a substantially parallel pair of collars.

5. The device of claim 4 wherein each collar of said pair of collars is resilient, and wherein said each collar has a central aperture therethrough for receiving an end of the spindle in journalled relation therethrough, and wherein said each collar has a gap providing for clipping of said each collar over an end of the spindle without having to remove the spindle from a corresponding wall mounting bracket.

6. The device of claim 4 wherein said pair of collars are each substantially toroidal.

7. The device of claim 2 wherein said brake arm and at least said cross member of said U-shaped member are resilient.

8. The device of claim 7 wherein said brake arm and at least said cross member of said U-shaped member are formed from one continuous integral piece.

9. The device of claim 8 wherein said brake arm is generally ▽ shaped and said Δ shape is contained generally within said U-shaped member when said brake arm is in an equilibrium position lying substantially in said plane of said U-shaped member and said U-shaped member is removed from the spindle.

10. The device of claim 9 wherein a narrow end of said brake arm is mounted to said cross member, and wherein said "▽" shape remains substantially planar as said brake arm is rotated from said equilibrium position into said roll engaging position and from said roll engaging position into said roll releasing position.

11. The device of claim 10 wherein a wider end of said brake arm at said distal end of said brake arm has a finger receiving curvature formed therein for hooking of said wider end by a user's digit, and wherein said wider end engages the roll of sheets.

12. The device of claim 11 wherein said cross member has two sections, each section of said two sections extending oppositely disposed between said narrower end of said brake arm and said pair of legs, and wherein said each section resiliently twists along its length during said rotation of said brake arm between said equilibrium position and said roll releasing position so as to provide said biasing means.

13. The device of claim 1 further comprising friction enhancing means mounted at said distal end of said brake arm for increasing friction between said brake arm and the surface of the roll of sheets when said brake arm is in said roll engaging position.

14. The device of claim 2 wherein said brake arm is rotatably mounted by a swivel mounted on said cross member.

15. The device of claim 14 wherein said biasing means is a spring mounted in said swivel so as to be rigidly mounted at one end of said spring to said brake arm and at an opposite end of said spring to said cross member.

16. The device of claim 14 wherein said brake arm is T-shaped and a cross piece of said T-shape is at said distal end of said brake arm for engaging the roll of sheets.

17. The device of claim 13 wherein said friction enhancing means are pads mounted on lands on said distal end of said brake arm.

18. The device of claim 16 wherein said friction enhancing means are inserts mounted on said cross piece.

* * * * *